US007093915B2

(12) United States Patent
Freire

(10) Patent No.: US 7,093,915 B2
(45) Date of Patent: Aug. 22, 2006

(54) CONTROLLING DIRECTION OF SATELLITE DROPLET EJECTION IN INK JET PRINTER

(75) Inventor: Eduardo Mariano Freire, Kennett Square, PA (US)

(73) Assignee: Xerox Corporation, Stamford, CT (US)

( * ) Notice: Subject to any disclaimer, the term of this patent is extended or adjusted under 35 U.S.C. 154(b) by 246 days.

(21) Appl. No.: 10/881,680

(22) Filed: Jun. 30, 2004

(65) Prior Publication Data

US 2006/0001685 A1 Jan. 5, 2006

(51) Int. Cl.
*B41J 29/38* (2006.01)
*B41J 2/015* (2006.01)

(52) U.S. Cl. ..... 347/9; 347/10; 347/20

(58) Field of Classification Search ..... 347/9, 347/10, 20

See application file for complete search history.

(56) References Cited

U.S. PATENT DOCUMENTS 4,463,359 A 7/1984 Ayata et al.
5,142,296 A 8/1992 Lopez et al.
5,192,959 A 3/1993 Drake et al.
5,461,406 A 10/1995 Lorenze, Jr. et al.
5,594,478 A 1/1997 Matsubara et al.
2003/0179258 A1* 9/2003 Freire et al. ..... 347/20
2005/0083373 A1* 4/2005 Gibson et al. ..... 347/47

* cited by examiner

*Primary Examiner*—Lamson Nguyen
*Assistant Examiner*—Jannelle M. Lebron
(74) *Attorney, Agent, or Firm*—Fay, Sharpe, Fagan, Minnich & McKee, LLP

(57) ABSTRACT

A method of printing with a fluid jet printer (10) is provided. The printer (10) has a printhead (12) with a fluid ejecting face (12*a*) facing a recording medium (14), the fluid ejecting face (12*a*) having at least one fluid ejector (18) arranged thereon. The method includes: imparting movement to at least one of the fluid ejector (18) and the recording medium (14) such that the recording medium (14) moves relative to the fluid ejector (18) along a fast scan direction (32) at a velocity ($v_m$); and, selectively ejecting fluid from the fluid ejector (18) toward the recording medium (14) as the movement is being imparted, such that: (i) a main drop is formed and has a first velocity ($v_d$) in a first direction; and, (ii) a satellite droplet is formed and has a second velocity ($v_s$) in a second direction that forms an angle ($\theta$) with respect to the first direction, wherein $\theta$ substantially satisfies the equation: $\tan\theta = v_m[1/(v_s \cos\theta) - 1/v_d]$.

15 Claims, 4 Drawing Sheets

CONTROLLING DIRECTION OF SATELLITE DROPLET EJECTION IN INK JET PRINTER

BACKGROUND

The present inventive subject matter relates to the imaging arts. It finds particular application in conjunction with ink jet image rendering devices, and will be described with particular reference thereto. However, one of ordinary skill in the art will appreciate that it is also amenable to other like applications.

Fluid ejector systems, such as drop-on-demand liquid ink jet printers, utilize various methods to eject fluids, including but not limited to piezoelectric, acoustic, and thermal methods. These systems often include a printhead having an ink ejecting face that faces a recording medium, such as a sheet of paper. Included in the printhead is an array of fluid ejectors from which drops of fluid are ejected towards a recording medium, substantially normal thereto.

In a printing operation, commonly, at least one of the printhead and recording medium are advanced such that they move relative to one another while the fluid ink is being ejected. Typically, the relative movement between the printhead and recording medium is along a so called fast scan direction which is substantially parallel to the plane of the recording medium and substantially perpendicular to the array of ejectors which are typically aligned in a so called slow scan direction. In some applications, a so called wide array printhead is employed where the ejectors are aligned along substantially the entire width of the medium which is typically advanced unidirectionally past the printhead. See, for example, the page width fluid ejector printer described in U.S. Pat. No. 5,192,959, incorporated herein by reference in its entirety.

Typically, for each ejector, a channel or capillary is defined to contain the fluid ink. Propelling pulses are used to cause the drops of fluid to be expelled at desired times from orifices or nozzles that are located on the ink ejecting face of the printhead and that are defined at one end of each of the channels. A supply container supplies the fluid to the plurality of channels.

For example, in a thermal fluid ejection system, the propelling pulses are produced, for example, by resistive heaters that are selectively energized. A heater is typically provided for each of the channels. Each heater is typically individually addressable to heat and vaporize fluid in one of the channels thereby ejecting a drop from the nozzle of the channel coupled to the addressed heater.

Typically, in addition to the main drop formed and ejected, a satellite droplet is also formed and ejected. For example, this phenomena is described in a published U.S. Patent Application to Freire, et al., Pub. No. U.S. 2003/0179258, incorporated by reference herein in its entirety.

The velocity of the satellite droplet is generally smaller than the velocity of the main drop. Accordingly, the relative movement between the recording medium and the printhead tends to result in the lagging satellite droplet landing on the recording medium in front of the main drop relative to the printhead fast scan direction. When the satellite droplets land on the recording medium outside the landing of their corresponding main drop, undesirable image artifacts can arise. For example, edges in the rendered image may appear ragged, or the effective area of ink coverage may be undesirably increased.

Accordingly, a new and improved apparatus and/or method for ink jet printing is disclosed that overcomes the above-referenced problems and others.

BRIEF DESCRIPTION

In accordance with one exemplary embodiment, a method of printing with a fluid jet printer is provided. The printer has a printhead with a fluid ejecting face facing a recording medium, the fluid ejecting face having at least one fluid ejector arranged thereon. The method includes: imparting movement to at least one of the fluid ejector and the recording medium such that the recording medium moves relative to the fluid ejector along a fast scan direction at a velocity ($v_m$); and, selectively ejecting fluid from the fluid ejector toward the recording medium as the movement is being imparted, such that: (i) a main drop is formed and has a first velocity ($v_d$) in a first direction; and, (ii) a satellite droplet is formed and has a second velocity ($v_s$) in a second direction that forms an angle ($\theta$) with respect to the first direction, wherein $\theta$ substantially satisfies the equation: $\tan\theta = v_m[1/(v_s \cos\theta) - 1/v_d]$.

In accordance with another exemplary embodiment, a printer is provided having a printhead with a fluid ejecting face facing a recording medium, the fluid ejecting face having at least one fluid ejector arranged thereon. The printer also includes: means for imparting movement to at least one of the fluid ejector and the recording medium such that the recording medium moves relative to the fluid ejector along a fast scan direction at a velocity ($v_m$); and, means for selectively ejecting fluid from the fluid ejector toward the recording medium as the movement is being imparted, such that: (i) a main drop is formed and has a first velocity ($v_d$) in a first direction; and, (ii) a satellite droplet is formed and has a second velocity ($v_s$) in a second direction that forms an angle ($\theta$) with respect to the first direction, wherein $\theta$ substantially satisfies the equation: $\tan\theta = v_m[1/(v_s \cos\theta) - 1/v_d]$.

In accordance with yet another exemplary embodiment, a printer includes: a printhead having a fluid ejecting face; a medium handler that advances a recording medium in a fast scan direction past the fluid ejecting face of the printhead; and, an ejector assembly carried by the printhead, the ejector assembly including at least one ejector that ejects fluid from the fluid ejecting face of the print head toward the recording medium. Upon ejection of fluid from the ejector, a main drop is formed and has a first velocity ($v_d$) in a first direction, and a satellite droplet is formed and has a second velocity ($v_s$) in a second direction that forms an angle ($\theta$) with respect to the first direction, the angle $\theta$ substantially satisfying the equation: $\tan\theta = v_m[1/(v_s \cos\theta) - 1/v_d]$.

Numerous advantages and benefits of the inventive subject matter disclosed herein will become apparent to those of ordinary skill in the art upon reading and understanding the present specification.

BRIEF DESCRIPTION OF THE DRAWINGS

The present inventive subject matter may take form in various components and arrangements of components, and in various steps and arrangements of steps. The drawings are only for purposes of illustrating preferred embodiments and are not to be construed as limiting. Further, it is to be appreciated that the drawings are not to scale.

DETAILED DESCRIPTION

Figure 1:
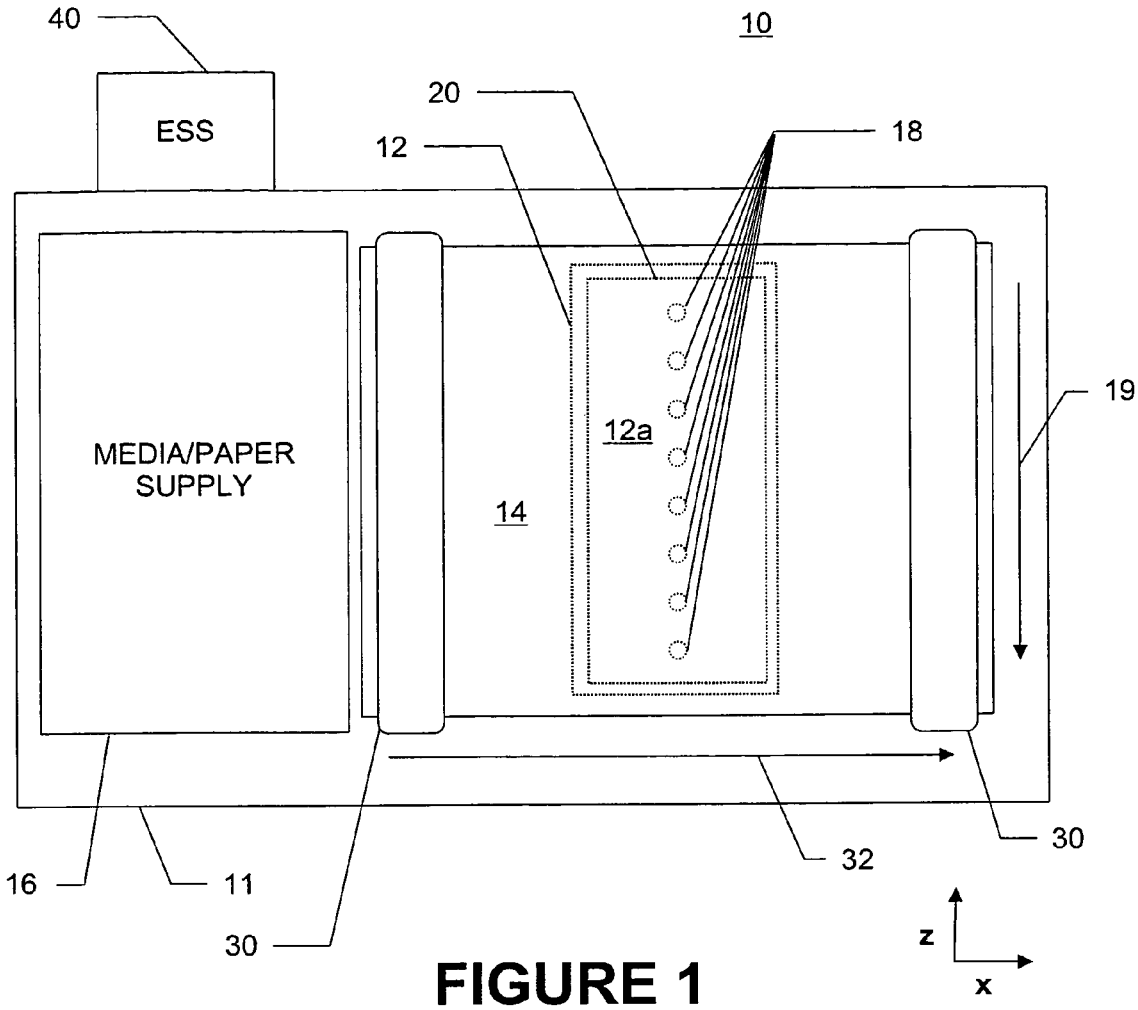
FIG. 1 is a diagrammatic illustration showing a front view of an ink jet printer embodying aspects of the present inventive subject matter, and showing elements in dashed lines behind a sheet of recording medium.

With reference to FIG. 1, there is illustrated a drop-on-demand ink jet printing machine 10. The printer 10 includes a frame or housing 11 to which are mounted directly or indirectly operating subsystems and components, as will be described below. As illustrated, the machine 10 is a printer. However, alternately the machine may be a copier, fax machine, multi-function device, or the like. While described below with reference to ink and/or ink fluids, in a more general embodiment, the machine 10 is fluid ejector print, for example, which deposits any suitable fluid (be it ink, non-ink or otherwise) on a receiving medium in a desired pattern.

The printer 10 includes a printhead 12 having an ink ejecting face 12*a* that faces a recording medium 14 such as a sheet of paper or other suitable recording media supplied from a paper/media supply 16, for example, a paper tray or the like. Included in the printhead 12 is an array of fluid ejectors 18 from which drops of fluid are ejected towards the recording medium 14. Suitably, the ejectors 18 are aligned in a process or slow scan direction indicated by arrow 19.

Figure 2:
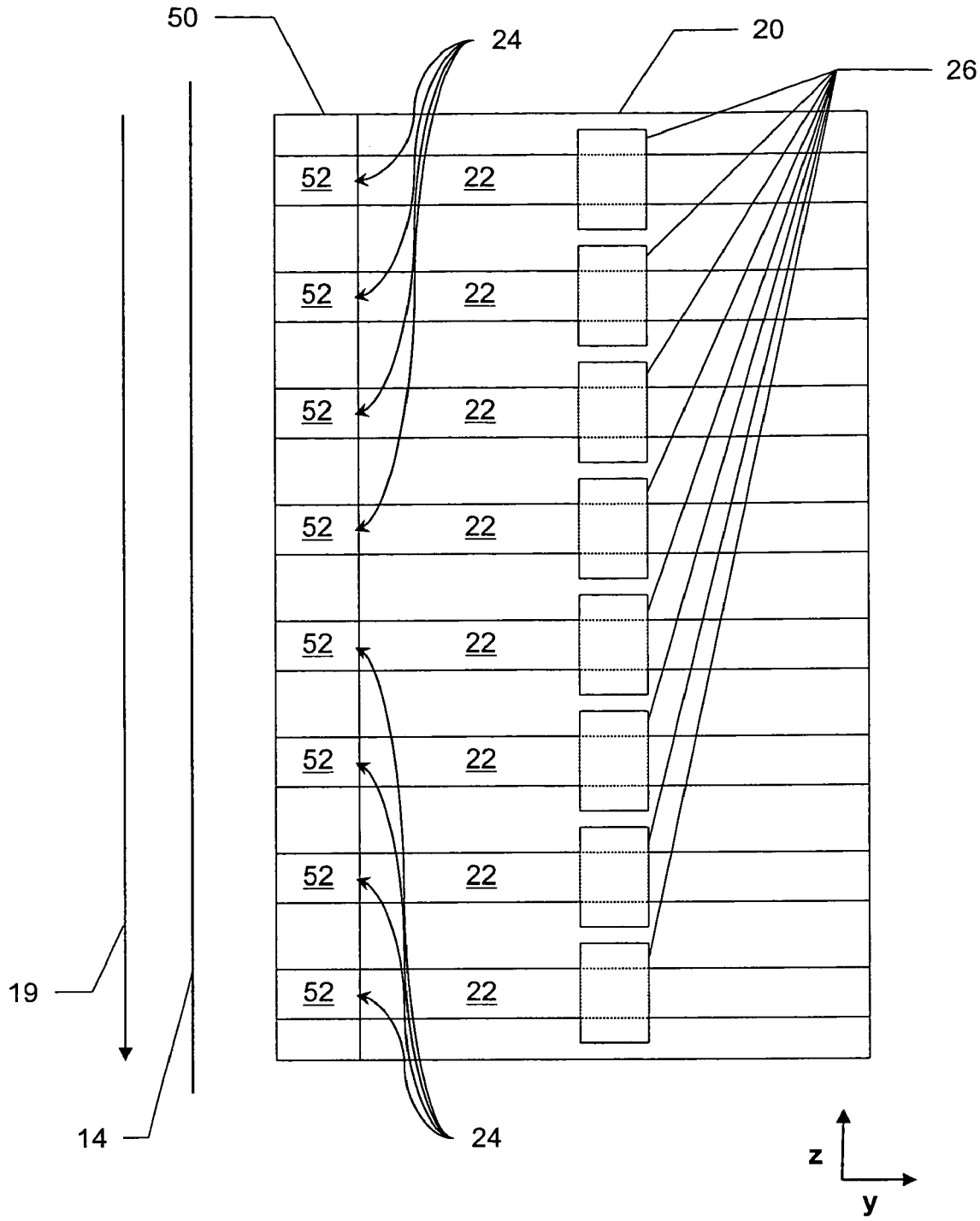
FIG. 2 is a diagrammatic illustration showing a side cross section view of an exemplary ejector assembly shown in FIG. 1.

With reference to FIG. 2 and continuing reference to FIG. 1, the ejectors 18 are constructed from or otherwise formed in an ejector assembly 20 carried by or integral with the printhead 12. For each ejector 18, a capillary or channel 22 is defined to contain fluid ink. Propelling pulses are used to cause the drops of fluid to be expelled at desired times from orifices 24 that are located proximate the ink ejecting face 12*a* of the printhead 12 and that are defined at one end of each of the channels 22. Suitably, a supply container (not shown) supplies the fluid ink to the plurality of channels 22.

Suitably, a thermal fluid ejection approach is employed. In the thermal fluid ejection, propelling pulses are produced, for example, by resistive heaters 26 that are selectively energized. A heater 26 is provided for each of the channels 22. Each heater 26 is typically individually addressable to heat and vaporize fluid in one of the channels 22 thereby producing propulsion and ejection of a drop from the orifice 24 of the channel 22 coupled to the addressed heater 26. Alternately, other known fluid propulsion and/or ejection approaches including but not limited to other thermal approaches, piezoelectric approaches and acoustic approaches are optionally employed to propel and/or eject ink from the channels 22.

As further shown in FIG. 1, the printer 10 includes a media handling system 30, for example, including rollers, belts and/or other like components that feed and/or otherwise manipulate and/or hold the media 14. Suitably, the handling system 30 retrieves or otherwise obtains media 14 from the media supply 16 and advances it past the ink ejecting face 12*a* of the printhead 12 in a fast scan direction indicated by arrow 32 which is, for example, substantially perpendicular to the slow scan or process direction 19. In an alternate embodiment, the printer 10 may optionally be configured as a page width fluid ejector print, like the one described in U.S. Pat. No. 5,192,959, incorporated herein by reference in its entirety.

Operation and control of the various subsystems, components and functions of the printer 10 are performed with the aid of a controller or electronic subsystem (ESS) 40. The controller or ESS 40 for example is a self-contained, dedicated mini-computer having a central processor unit (CPU), electronic storage, and a display or user interface (UI). The controller or ESS 40 for example includes sensor input and control means as well as a pixel placement and control means. In addition the CPU reads, captures, prepares and manages the image data flow between image input sources such as a scanning system, or an online or a work station connection, and the printhead 12. As such, the controller or ESS 40 is the main multi-tasking processor for operating and controlling the printer's subsystems and functions, including the printer's printing operations.

Suitably, for printing operations, image data for an image to be produced is sent to the controller or ESS 40 from either the scanning system or via the online or work station connection for processing and output to the printhead 12. Additionally, the controller determines and/or accepts related subsystem and component controls, for example from operator inputs via the user interface, and accordingly executes such controls. As a result, ink is appropriately delivered to and ejected from the printhead 12. Additionally, pixel placement control is exercised relative to the recording media 14 thus forming desired images per such image data, and the recording media 14 is supplied by the media supply 16 and handled by the handling system 30 in timed registration with the image formation.

As is appreciated by those of ordinary skill in the art, ink ejection of the type contemplated herein typically results in the formation of a main drop along with at least one generally smaller satellite droplet. In a preferred embodiment, the direction of the satellite droplet is advantageously regulated or control. Returning attention to FIG. 2 and with additional reference to FIG. 3, a nozzle plate 50 is mounted to or otherwise arranged on the ejector assembly 20 proximate the ink ejecting face 12*a* of the printhead 12. The nozzle plate 50 has a plurality of nozzles 52 corresponding to the orifices 24 at the end of channels 22. The propelled slugs of ink from the respective channels 22 are ultimately ejected through the respective nozzles 52 of the nozzle plate 50.

Figure 3:
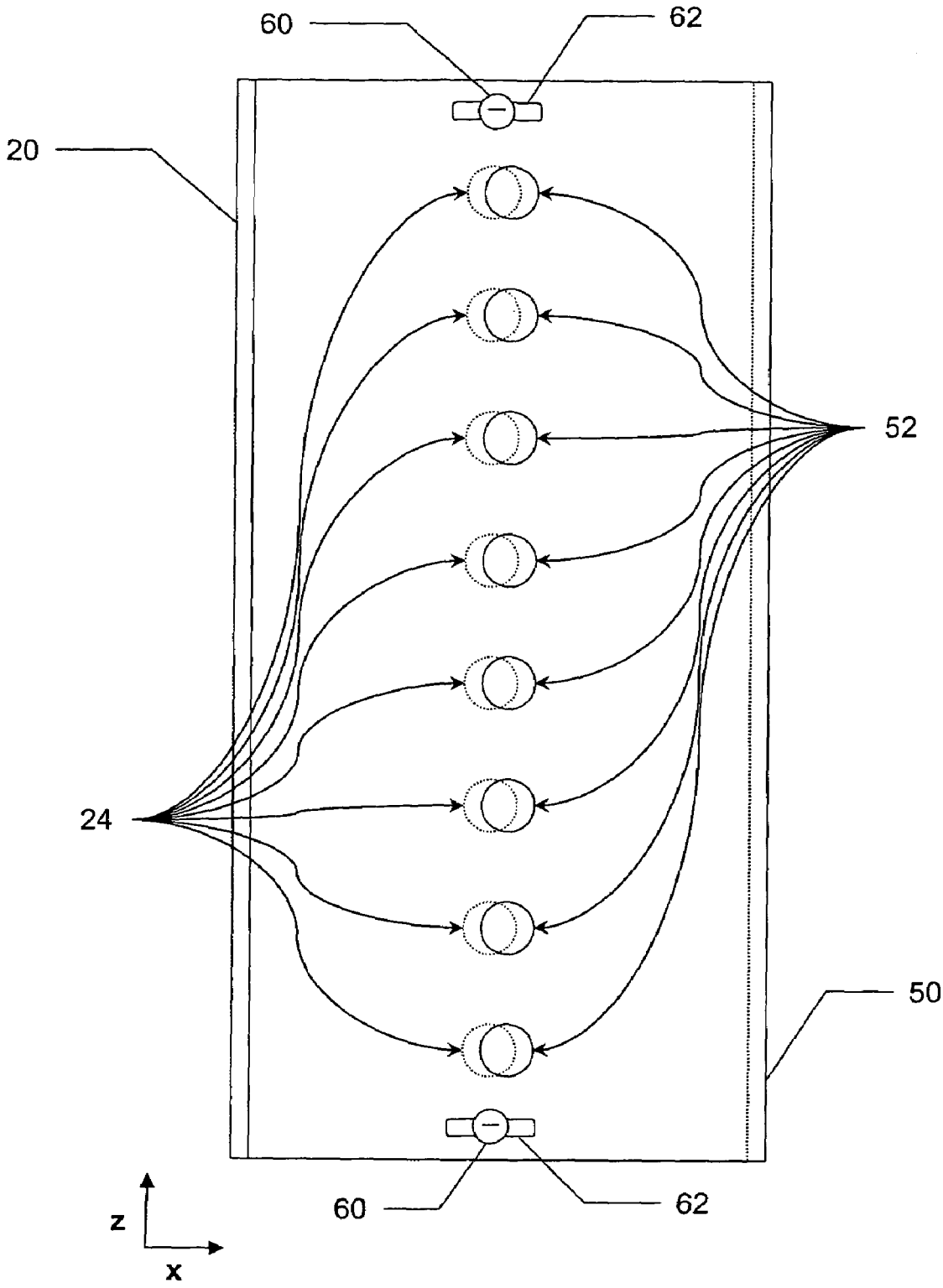
FIG. 3 is a diagrammatic illustration showing a front view of the ejector assembly shown in FIG. 2, and showing elements in dashed lines behind an exemplary nozzle plate.

Notably, by offsetting the nozzles 52 with respect to their corresponding orifices 24 (as best seen in FIG. 3), the direction of produced satellite droplets is controlled and/or regulated. That is to say, the satellite droplets tend to be directed in the same direction as the offset without significantly altering the direction of the main drop, provided the offset is not overly large.

Optionally, the offset is adjustable so as to allow for variably control of the direction of the satellite droplets. For example, the nozzle plate 50 is optionally mounted to the ejector assembly 20 with a pair of screws 60 or the like that pass through slots 62 formed in the nozzle plate 50. Accordingly, with the screws 60 loosen, the plate 50 is able to be variable offset as desired in the direction of the slots 62. When the desired offset is achieved resulting in the desired directional control of the satellite droplets, the screws 60 are tightened to hold the nozzle plate 50 in place.

Figure 4:
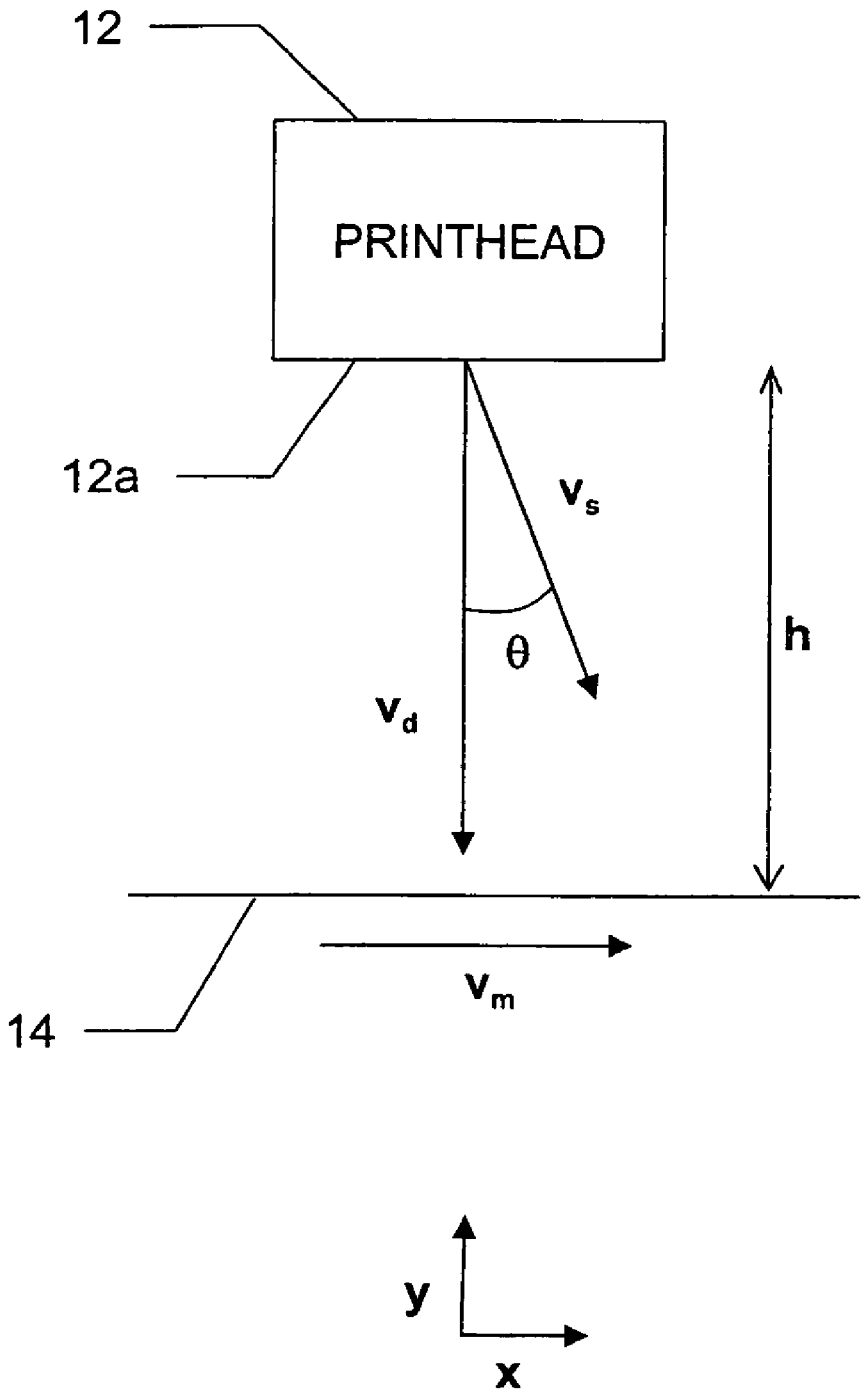
FIG. 4 is a diagrammatic illustration showing a top view of an exemplary ejection of ink toward an advancing recording medium by an exemplary printhead shown in FIG. 1.

With reference now to FIG. 4, in one suitable embodiment, the recording medium 14 is advanced past the ink ejecting face 12*a* of the printhead 12 with a velocity $v_m$ as an ejector 18 ejects ink toward the medium 14. As shown, the medium is being advanced in the fast scan direction 32. The throw distance h is the distance between the ink ejecting face 12*a* of the printhead 12 and the medium 14.

For exemplary purposes, a single ejection of ink from one ejector 18 is now described. In response to energizing one of the heaters 26, ink is propelled and ejected from the associated ejector 18 toward the advancing medium 14. The ejected ink forms a main drop having a velocity $v_d$. Suitably, $v_d$ is oriented substantially normal to the recording medium 14. In addition to the main drop, a satellite droplet is also formed having a velocity $v_s$. Suitably, $v_s$ is less than $v_d$.

To advantageously have the satellite droplet land on the advancing recording medium 14 at substantially the same location as the main drop, the satellite droplet is directed at an angle θ with respect to the direction of the main drop. By inspection of FIG. 4, the locations where the main drop and satellite droplets land on the advancing medium 14 along the x-axis are given by:

$$x_d=-hv_m/v_d \quad (1);$$

and, $$x_x=[h/(v_s \cos \theta)][-v_m+v_s \sin \theta] \quad (2),$$

respectively. It follows then that the distance between the main drop and satellite droplet is:

$$\Delta x=-hv_m[1/(v_s \cos \theta)-1/v_d]+h \tan \theta \quad (3).$$

To have the satellite droplet land on the same location as the main drop, the distance between the main drop and the satellite droplets is set to zero (i.e., Δx=0). Accordingly, the angle θ is made to satisfy the equation:

$$o=-hv_m[1/(v_s \cos \theta)-1/v_d]+h \tan \theta \quad (3);$$

or, $$\tan \theta=v_m[1/(v_s \cos \theta)-1/v_d] \quad (4).$$

Further, by empirically or otherwise determining the angle θ as a function nozzle offset, one can obtain from equation (4) the desired offset as a function medium velocity $v_m$, main drop velocity $v_d$, and satellite droplet velocity $v_s$. Still further, by measuring $v_d$ and $v_s$, one obtains an expression relating the desired offset to the medium velocity $v_m$. Accordingly, the offset can be set bases on these measured or otherwise known parameters. Alternately, to compensate for varying parameters or to accommodate different applications having different parameters, one is may adjust the offset, for example, using the screws 60 and slots 62 or an alternately provided adjustment mechanism.

While the directional control of the satellite droplets has been achieved in the foregoing embodiment by offsetting the nozzles 52 with respect to their corresponding orifices 24, alternately, other approaches and/or method are employed for directing the satellite droplets at the angle θ with respect to the direction of the main drop. For example, the approaches and/or methods described in the published U.S. Patent Application to Freire, et al., Pub. No. U.S. 2003/0179258, incorporated by reference herein in its entirety, are optionally employed. One option for angularly directing the satellite droplet employs no nozzle plate 50. Rather, the channels 22 themselves are formed with a suitable geometry to direct the satellite droplets at the desired angle. For example, as opposed to being cylindrical, the channels 22 may have a geometry that produces an asymmetrical orifice 24 with respect to the process direction. Optionally, where the channels 22 are formed between two adjoining wafers or portions of the ejector assembly 20, the wafers or portion are optionally made of different materials.

Additionally, while the relative movement between the printhead 12 and the medium 14 has been achieved by advancing the medium 14 past the ink ejecting face 12*a* of the printhead 12, alternately, the same relative movement is achieved by advancing the printhead 12 across a stationary medium, or optionally the same relative movement is achieved by moving both the printhead 12 and the medium 14.

Suitably, for unidirectional printing (i.e., where ink is ejected during only one direction of relative medium movement), it suffices to angularly direct satellites droplets only in the direction of the relative medium movement. However, for bidirectional printing (i.e., where ink is ejected during both the forward and reverse directions of relative medium movement), optionally, the satellite droplets from a first set of ejectors 18 are directed one way, while the satellite droplets from a second set of ejectors 18 are directed the opposite way. For example, a first set of nozzles 52 are optionally offset from their respective orifices 24 in a first direction corresponding to the forward fast scan direction, and a second set of nozzles 52 are optionally offset from their respective orifices 24 in a second direction corresponding to the reverse fast scan direction. Accordingly, the first set of ejectors 18 are employed when printing in the forward fast scan direction, and the second set of ejectors 18 are employed when printing in the reverse fast scan direction.

In connection with the particular exemplary embodiments presented herein, certain structural and/or function features are described as being incorporated in particular embodiments. It is to be appreciated that different aspects of the exemplary embodiments may be selectively employed as appropriate to achieve other alternate embodiments suited for desired applications, the other alternate embodiments thereby realizing the respective advantages of the aspects incorporated therein.

Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the inventive subject matter be construed as including all such modifications and alterations insofar as they come within the scope of the appended claims or the equivalents thereof.

The invention claimed is:

1. A method of printing with a fluid jet printer having a printhead with a fluid ejecting face facing a recording medium, the fluid ejecting face having at least one fluid ejector arranged thereon, the method comprising:

(a) imparting movement to at least one of the fluid ejector and the recording medium such that the recording medium moves relative to the fluid ejector along a fast scan direction at a velocity ($v_m$); and, (b) selectively ejecting fluid from the fluid ejector toward the recording medium as the movement is being imparted, such that:

(i) a main drop is formed and has a first velocity ($v_d$) in a first direction; and, (ii) a satellite droplet is formed and has a second velocity ($v_s$) in a second direction that forms an angle (θ) with respect to the first direction, wherein θ substantially satisfies the equation:

$$\tan\theta = v_m[1/(v_s\cos\theta) - 1/v_d]$$

where tan is the trigonometry tangent function, and cos is the trigonometry cosine function.

2. The method of claim 1, wherein $v_s$ is less than $v_d$.

3. The method of claim 1, wherein the first direction is substantially normal to the recording medium.

4. The method of claim 1, wherein step (b) comprises:

ejecting fluid from a channel's orifice through a nozzle, the nozzle being offset with respect to the orifice.

5. The method of claim 4, wherein the offset of the nozzle with respect to the orifice is adjustable, the adjustment changing the angle θ.

6. A printer having a printhead with a fluid ejecting face facing a recording medium, the fluid ejecting face having at least one fluid ejector arranged thereon, the printer comprising:

means for imparting movement to at least one of the fluid ejector and the recording medium such that the recording medium moves relative to the fluid ejector along a fast scan direction at a velocity ($v_m$); and, means for selectively ejecting fluid from the fluid ejector toward the recording medium as the movement is being imparted, such that:

(i) a main drop is formed and has a first velocity ($v_d$) in a first direction; and, (ii) a satellite droplet is formed and has a second velocity ($v_s$) in a second direction that forms an angle (θ) with respect to the first direction, wherein θ substantially satisfies the equation:

$$\tan\theta = v_m[1/(v_s\cos\theta) - 1/v_d]$$

where tan is the trigonometry tangent function, and cos is the trigonometry cosine function.

7. The printer of claim 6, wherein $v_s$ is less than $v_d$.

8. The printer of claim 6, wherein the first direction is substantially normal to the recording medium.

9. The printer of claim 6, wherein the ejector includes a channel having an orifice at an end thereof from which the fluid is ejected through a nozzle, the nozzle being offset with respect to the orifice.

10. The printer of claim 9, further comprising:

means for adjusting the offset of the nozzle with respect to the orifice, the adjustment changing the angle θ.

11. A printer comprising:

a printhead having a fluid ejecting face;

a medium handler that advances a recording medium in a fast scan direction past the fluid ejecting face of the printhead; and, an ejector assembly carried by the printhead, the ejector assembly including at least one ejector that ejects fluid from the fluid ejecting face of the print head toward the recording medium;

wherein upon ejection a main drop is formed and has a first velocity ($v_d$) in a first direction, and a satellite droplet is formed and has a second velocity ($v_s$) in a second direction that forms an angle (θ) with respect to the first direction, the angle θ substantially satisfying the equation:

$$\tan\theta = v_m[1/(v_s\cos\theta) - 1/v_d]$$

where tan is the trigonometric tangent function, and cos is the trigonometric cosine function.

12. The printer of claim 11, wherein the ejector includes a channel having an orifice at an end thereof from which the fluid is ejected through a nozzle, the nozzle being offset with respect to the orifice.

13. The printer of claim 12, further comprising:

means for adjusting the offset of the nozzle with respect to the orifice, the adjustment changing the angle θ.

14. The printer of claim 13, wherein $v_s$ is less than $v_d$ and the first direction is substantially normal to the recording medium.

15. The printer of claim 14, further comprising:

a medium supply that supplies the medium to the medium handler.

* * * * *